United States Patent [19]

Hoshika et al.

[11] Patent Number: 4,916,492

[45] Date of Patent: Apr. 10, 1990

[54] DEVELOPER METHOD AND APPARATUS

[75] Inventors: Norihisa Hoshika, Kawasaki; Hatsuo Tajima, Matsudo; Masaaki Yamaji; Atsushi Hosoi, both of Tokyo; Hiroshi Tajika, Yokohama, all of Japan

[73] Assignee: Canon Kabushiki Kaisha, Tokyo, Japan

[21] Appl. No.: 258,059

[22] Filed: Oct. 17, 1988

Related U.S. Application Data

[63] Continuation of Ser. No. 15,929, Feb. 18, 1987, abandoned.

[30] Foreign Application Priority Data

| | | | |
|---|---|---|---|
| Feb. 20, 1986 | [JP] | Japan | 61-35458 |
| Jun. 24, 1986 | [JP] | Japan | 61-147425 |
| Jun. 24, 1986 | [JP] | Japan | 61-147428 |

[51] Int. Cl.[4] ..... G03G 15/09; G03G 13/09

[52] U.S. Cl. ..... 355/253; 118/657; 430/122

[58] Field of Search ..... 355/3 DD, 14 D, 245, 355/251, 253; 118/657, 658; 430/122

[56] References Cited

U.S. PATENT DOCUMENTS

| | | | |
|---|---|---|---|
| 4,517,274 | 5/1985 | Honda et al. | 118/657 X |
| 4,554,234 | 11/1985 | Imai et al. | 118/658 X |
| 4,559,899 | 12/1985 | Kan et al. | 118/657 |
| 4,571,372 | 2/1986 | Urawa et al. | 118/657 X |
| 4,579,082 | 4/1986 | Murasawa et al. | 118/658 |
| 4,583,490 | 4/1986 | Kan et al. | 118/658 |
| 4,606,990 | 8/1986 | Yoshikawa | 118/658 X |
| 4,607,938 | 8/1986 | Hosoi et al. | 355/3 DD |
| 4,615,608 | 10/1986 | Mizutani | 355/3 DD |
| 4,637,706 | 1/1987 | Hosoi et al. | 355/3 DD |
| 4,638,760 | 1/1987 | Nakamura et al. | 118/658 |
| 4,653,427 | 3/1987 | Hosaka et al. | 118/658 |
| 4,660,958 | 4/1987 | Egami et al. | 355/3 DD |

*Primary Examiner*—Fred L. Braun

*Attorney, Agent, or Firm*—Fitzpatrick, Cella, Harper & Scinto

[57] ABSTRACT

A developing method utilizing a developer including a mixture of magnetic carrier particles and toner particles wherein a stationary layer containing magnetic particles is formed on a developer carrying member in a developer container. The stationary layer is allowed to expand and contract in order to control an area of the developer supplying opening upstream of the stationary layer with respect to movement of the developer carrying member thus stabilizing the toner content in the developer supplied to the developing station.

30 Claims, 7 Drawing Sheets

DEVELOPER METHOD AND APPARATUS

This application is a continuation of application Ser. No. 015,929 filed Feb. 18, 1987, now abandoned.

FIELD OF THE INVENTION AND RELATED ART

The present invention relates to a developing method and a developing apparatus embodying the method, wherein a latent image is developed by two component developer containing magnetic particles and toner particles mixed together.

A developing system using one component magnetic toner and a developing system using two component developer, are known. With respect to each of the developing systems, it is also known that the development effect can be enhanced by applying an alternating electric field at the developing station, as disclosed, for example, U.S. Pat. Nos. 4,395,476; 4,425,373; 4,292,387; 4,548,489; 4,579,082; and 4,563,978, all of which have been assigned to the assignee of the present application.

In the developing system disclosed in the U.S. Pat. Nos. 4,395,476; 4,425,373; and 4,292,387, a thin layer of the developer having such a thickness that the developer does not contact the latent image, is formed on a developer carrying member, which will hereinafter be called "sleeve", and then, the developer in the form of a thin layer is brought close to the latent image, where an electric field is formed between the latent image and the developer layer. Since this system uses the one component magnetic toner, it is preferable to employ a developing magnetic pole and to move the sleeve and the latent image bearing member, which hereinafter will be called "drum", at the same peripheral speed in the same direction. This system is found to be very useful since the image reproducibility is good, since the development efficiency (the ratio of the toner to be consumed for the developing action to the toner present at the developing position) is high, and also since the size of the developing device can be reduced.

However, the developer particle contains a relatively large amount of magnetic material, and therefore, it is not suitable for the image formation in non-black colors, e.g., red, blue or the like because the color is not bright enough due to the presence of the magnetic material which is usually black in color. In addition, the image formed with the one component magnetic developer is not strongly fixed on a recording member such as paper by fixing means. Practically, those problems are not very significant. However, from the standpoint of enhancing the quality of the image, they should be solved.

As a developing system wherein those problems have been solved, the U.S. Pat. Nos. 4,548,489; 4,579,082; and 4,563,978 have proposed a system wherein two component developer containing non-magnetic toner particles and magnetic particles are accommodated in a developer container. A thin layer comprising only the non-magnetic toner particles is formed on a developer carrying sleeve. The thin layer of the non-magnetic toner particles is opposed to a latent image to be developed, where an alternating electric field is formed between the latent image and the sleeve. This system does not involve the above described problems arising from the magnetic material, because at the developing position, one-component developer is used. However, this system has a problem that the image density of the developed image is relatively low and a problem in the development characteristics, such as a negative property (the image density decreases with increase of the latent image potential) which will be described in detail hereinafter.

On the other hand, a developing system wherein two component developer is brought to the developing position, is known, as disclosed in Japanese Laid-Open Patent Application No. 93841/1978, for example. In this system, a large amount of magnetic brush constituted by magnetic particles is supplied to the developing position, with the result that only the toner particles that exist adjacent the free ends of the magnetic brush can participate in the actual developing action. In order to increase the image density by causing a large amount of the magnetic brush (not less than 5 mm) to contact the drum, the rotational speed of the sleeve is increased to be not less than three times the drum rotational speed. Additionally, since the percentage of the toner particles consumable for the development in the magnetic brush is small, the development efficiency is low. Furthermore, the developed image has a trace of brushing. In order for the sleeve to convey the large amount of the magnetic brush, high driving power is required. This is not advantageous since the uniform rotation can be damaged as well as the wasteful power consumption.

As for a developing system having a high development efficiency in the magnetic brush development using two component developer, a proposal has been made in Japanese Laid-Open Patent Application No. 32060/1980 filed by the assignee of the present application. In this system, the magnetic brush is formed at the developing position in an alternating electric field, by which the non-magnetic toner particles contained in the magnetic brush as well as those particles adjacent the free ends of the magnetic brush are usable for the developing action, thus increasing the development efficiency. It has been found that good images can be formed by this system.

However, this system which forms a large amount of the magnetic brush at the developing station, involves a problem that when the toner content controlled in the developer container changes, the change directly influences the image quality developed thereby. Therefore, it is inevitably required that the toner content is strictly controlled in the developer container. It is practically impossible to omit the toner content control means. As will be understood, the development efficiency is even better than the conventional systems described hereinbefore. However, wasteful magnetic particles and toner particles still have to be conveyed to the developing station.

As a proposal for solving those problems, U.S. patent application Ser. No. 257,164, filed Oct. 13, 1988, which is a continuation of Ser. No. 163,149, filed Feb. 25, 1988, which is a continuation of Ser. No. 906,080, filed Sept. 10, 1986 have been filed, which are assigned to the assignee of the present application.

The invention disclosed in the present application is mainly directed to stabilization of toner particle charging within the container, which is not particularly considered in the application for the invention made earlier than this application.

SUMMARY OF THE INVENTION

It is a principal object of the present invention to provide a developing method and a developing apparatus wherein the triboelectric charging of the toner particles is stabilized under wide developing conditions in the developing station.

It is another object of the present invention to provide a developing method and a developing apparatus wherein consumption of the magnetic particles resulting from the developing operation is minimized, whereby the capability of toner charging is stabilized.

It is a further object of the present invention to provide a developing method and a developing apparatus wherein the toner content in the developer supplied to the developing station is automatically stabilized without use of a toner content detecting means.

It is a further object of the present invention to provide a developing method and a developing apparatus wherein the toner content is automatically stabilized even when a developer which is relatively readily deteriorated with use is employed.

It is a further object of the present invention to provide a developing method and a developing apparatus an improvement over the above mentioned U.S. patent application, Ser. No. 906,080 is made in the total system from within the container to the developing station.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
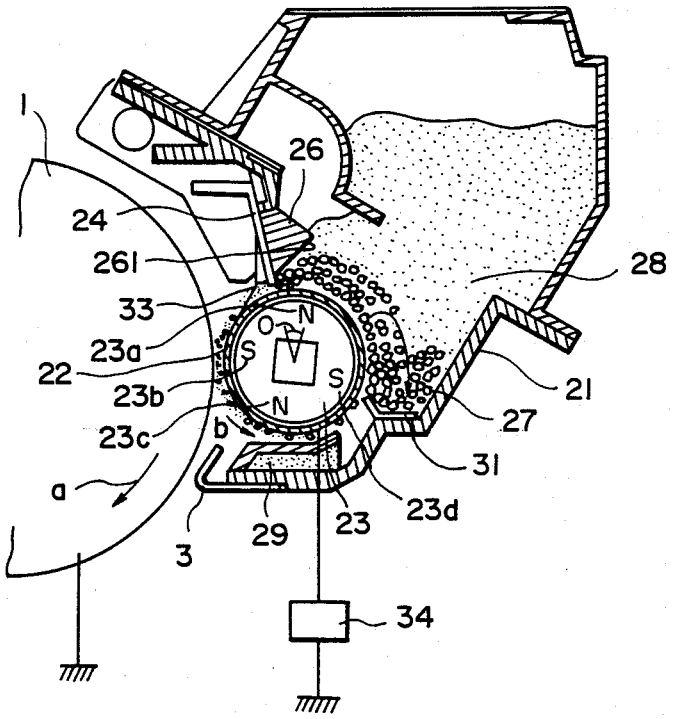
FIG. 1 is a sectional view of a developing apparatus according to an embodiment of the present invention which is suitable for a particle size distribution of the magnetic particles according to the present invention.

Referring to FIG. 1, there is shown a developing apparatus conveniently usable with the magnetic particle size distribution according to an embodiment of the present invention, wherein an electrostatic latent image bearing member for bearing the electrostatic latent image to be developed is indicated by a reference numeral 1. The image bearing member 1 is in this embodiment a photosensitive drum, but may be a photosensitive or dielectric drum or belt movable along an endless path. The process of forming an electrostatic latent image on the image bearing member is not the feature of the present invention, and any suitable electrostatic latent image formation process is usable. In this embodiment, the image bearing member is a photosensitive drum on which an electrostatic latent image is formed an electrophotograpic process. The photosensitive drum 1 is rotatable in the direction indicated by an arrow a.

The developing apparatus according to this embodiment comprises a developer container 21, a developing sleeve 22 (hereinafter will be called simply "sleeve") as the developer carrying member, a magnet 23 as the magnetic field generating means, a regulating blade 24 (hereinafter will also be called simply "blade") for regulating the amount of the developer conveyed to the developing position on the sleeve 22 and an electric power source 34 as the alternating electric field generating means. The structures of the respective elements will be described.

The container 21 contains the developer containing the magnetic particles 27 and the toner particles 28 mixed together. The toner particle in this embodiment is a non-magnetic toner particle having a particle size of 7–20 microns, mainly consisting of 10 parts of carbon and 90 parts of polystyrene, for example. The toner particles and the magnetic particles are accommodated in this embodiment such that the magnetic particle content is high in the neighborhood of the sleeve 22 surface but it is low away from the sleeve 22 surface. However, they may be contained under uniform content in the container 21. The container 21 has an opening at a left bottom position, as seen in FIG. 1.

The sleeve 22 is made of a non-magnetic material such as aluminum and is disposed in the opening of the container 21 with a part of its surface is exposed and the rest of the surface within the container 21. The sleeve 22 is rotatably supported along an axis perpendicular to the sheet of the drawing of FIG. 1 and is rotated in operation in the direction of an arrow b. In this embodiment, the sleeve 22 is illustrated as being a cylindrical sleeve, but it may be an endless belt.

The sleeve 22 is opposed to the photosensitive drum 1 with a small clearance to constitute a developing position or zone, to which the toner and magnetic particles are carried on the sleeve 22 so that the volumetric ratio of the magnetic particles therein is 1.5–30%. This will be described in detail hereinafter.

The magnet 23 is disposed in the sleeve 22. The magnet 23 is fixed so that it does not rotate when the sleeve 22 rotates. The magnet 23 has a magnetic pole 23*a* (N) cooperative with the blade 24 which will be described hereinafter to regulate the amount of the developer to be applied on the sleeve 22 as a developer layer, a developing pole 23*b* (S), magnetic poles 23*c* (N) and 23*d* (S) for collecting the developer after passing through the developing position back into the container 21. The polarities of the magnetic poles may be reversed. The magnet 23 is a permanent magnet in this embodiment, but it may be an electromagnet.

The blade 24 in this embodiment is made of a non-magnetic material such as aluminum at least at its free end portion. The blade 24 extends along the length of the sleeve 22 in the neighborhood of the upper portion of the opening of the container 21. The base portion of the blade 24 is fixed to the container 21. The free end of the blade 24 is opposed to the surface of the sleeve 22 with a clearance, which is 50–500 microns, preferably 100–350 microns. In this embodiment, the clearance is 250 microns. If the clearance is less than 50 microns, the clearance is easily clogged by the magnetic particles, whereas if it is larger than 500 microns, a too large amount of the magnetic particles and toner particles are passed through the clearance with the result that the suitable thickness of the developer layer can not be formed on the sleeve 22. The thickness of the layer is less than the clearance between the surface of the photosensitive drum 1 and the surface of the sleeve 22 at the developing position on the assumption that the magnetic force does not exist. In order to form the developer layer of this thickness, it is preferable that the clearance between the edge of the blade 24 and the surface of the sleeve 22 is equivalent or smaller than the clearance between the surface of the photosensitive drum 1 and the surface of the sleeve 22. However, it is possible to form such a layer with a larger clearance between the blade 24 and the sleeve 22. At the inside wall of the blade 24, there is provided a member 26 effective to limit the movement of the magnetic particles. The member 26 serves to limit the region of the magnetic particles within the container 21. The circulation will be described hereinafter.

The power source 34 applies a voltage between the photosensitive drum 1 and the sleeve 22 to form an alternating electric field across the clearance therebetween, by which the toner particles transfer onto the photosensitive drum 1 from the developer layer on the sleeve 22. The alternating voltage provided by the power source 34 may be symmetrical, that is, the peak voltages at the positive side and the negative side are equal, or may be an asymmetrical voltage which may be provided by superimposing a DC voltage to the symmetrical voltage. As an example, when the electrostatic latent image having a dark portion potential of −600 V and a light portion potential −200 V is to be developed, the sleeve 22 is supplied with the asymmetrical voltage of 200–3000 Hz having a peak-to-peak voltage of 300–2000 Vpp provided by a superimposed DC voltage of −300 V, while the photosensitive drum 1 is grounded.

The bottom portion of the container 21 extends toward the photosensitive drum 1 to form an extension to prevent the developer, particularly the toner particles, from scattering or leaking outside. In order to assure the prevention, a member 29 is fixed to the top surface of the extension in this embodiment so as to receive and confine the developer particles. To the edge of the extension, a member 3 is fixed extending along the length of the sleeve 22 to prevent the particles from scattering, as shown in the Figure. To the member 3, a voltage having the same polarity as the toner particles may be applied, whereby the toner scattered from the developing position is urged toward the photosensitive drum 1 by the electric field formed thereby, so as to prevent the toner scattering.

Adjacent the opposite ends of the sleeve 22, there is provided a developer limiting member (not shown), which functions to prevent the application of the developer on the sleeve 22 surface adjacent the longitudinal end portions of the sleeve.

The operation of the developing apparatus according to this embodiment will be described. First, the magnetic particles 27 are supplied into the container 21. Those magnetic particles are attracted and maintained on the sleeve 22 surface by the magnetic force provided by the magnetic poles **23*a* and 23*d* to cover the entire surface of the sleeve 22 within the container 21, thus forming a layer of magnetic particles. Those portions of the magnetic particle layer which are close to the magnetic poles 23*a* and 23*d* are formed into a magnetic brush. Subsequently, the toner particles 28 are supplied into the container 21, thus forming a toner layer outside the magnetic particle layer. It is preferable that the magnetic powder first supplied into the container 21 contains 2–70% by weight of the toner, but the powder may consist only of magnetic particles. After the magnetic particles 27 are once attracted to the surface of the sleeve 22 as the magnetic particle layer, they do not significantly flow or incline even when the developing apparatus vibrates or fairly inclines, and keep covering the surface of the sleeve 22**.

When the sleeve 22 rotates in the direction indicated by an arrow, the magnetic particles move upwardly in the direction along the surface of the sleeve 22 from the bottom portion of the container 21 to reach the neighborhood of the blade 24, where a part of the magnetic particles passes through the clearance between the sleeve 22 and the edge of the blade 24 together with the toner particles. The rest of the magnetic particles impinges on the member 26, and thereafter, is turned downwardly and is lowered by the gravity outside the rising passage to the bottom portion of the container 21. They again rise by the rotation of the sleeve 22 adjacent thereto. This is repeated to form a circulation of the magnetic particles. Among the magnetic particles 27 rising toward the blade 24 from the bottom portion of the container 21, there are particles which turn downwardly prior to reaching the neighborhood of the blade 24. The magnetic particles relatively away from the surface of the sleeve 22 tend to make this movement.

The magnetic powder turned in the neighborhood of or before the blade 24 takes thereinto the toner particles from the outside toner layer. During the circulation with the rotation of the sleeve 22, the toner particles 28 are triboelectrically charged by the friction with the magnetic particles 27 and the sleeve 22 surface.

Adjacent the position before the blade 24, the magnetic particles 27 near the surface of the sleeve 22 are attracted to the sleeve surface by the magnetic force of the magnetic pole **23*a*, and therefore, they pass under the blade 24 to go out of the container 21 with the rotation of the sleeve 22. During this movement, the magnetic particles 27 carry the toner particles deposited on their surfaces out of the container 21. Additionally, a part of the charged toner particles 28 are attracted onto the sleeve surface by image force and is also carried out of the container 21 on the sleeve 22. The blade 24 is effective to those developer applied on the sleeve 22** surface.

The layer of the developer (the mixture of the magnetic particles 27 and the toner particles 28) formed on the sleeve surface 22 is carried on the surface of the sleeve 22 to reach the developing position or zone where the sleeve 22, and therefore, the layer is opposed to the surface of the photosensitive drum 1. In the developing position, the toner particles are transferred onto the latent image on the photosensitive drum 1 both from the surfaces of the magnetic particles and from the surface of the sleeve 22 by the alternating electric field formed across the clearance between the photosensitive drum 1 and the sleeve 22, whereby the latent image is developed. The volumetric ratio of the magnetic particles in the developing position is preferably 1.5–30%, which will be described in detail hereinafter.

With the continued rotation of the sleeve 22, the toner particles and magnetic particles not having been consumed for the development are collected back into the container 21. They are mixed with the particles in the container 21 by the above described circulation and are again supplied on the sleeve 22. During this circulation, the magnetic powder takes thereinto the toner particles from the upper toner layer in the container 21, whereby it is resupplied with the toner by the amount which has been consumed.

Figure 2:
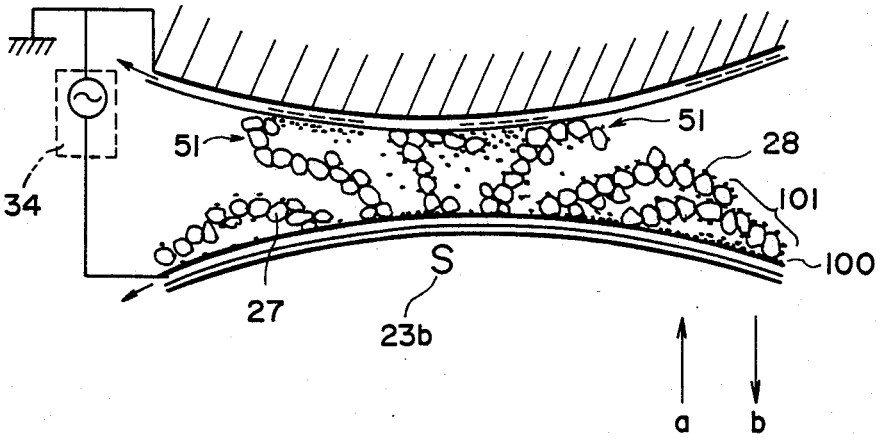
FIG. 2 is an enlarged sectional view at the developing position of the developing apparatus shown in FIG. 1, illustrating the method of development in the apparatus of FIG. 1.

FIG. 2 is a enlarged sectional view of the developing position illustrating the developing action. The photosensitive drum 1 retains the electric charge constituting the latent image. In this embodiment, the electric charge constituting the latent image is negative, and therefore, the toner particles are charged positive. In FIG. 2, the photosensitive drum 1 and the sleeve 22 rotate such that the peripheral movements thereof are co-directional, as indicated by the arrows. Across the clearance formed therebetween, the above described alternating voltage is applied from the power source 34. At a position corresponding to a position where the photosensitive drum 1 and the sleeve 22 are closest, the magnetic pole **23*b* of the magnet 23 is disposed within the sleeve 22**.

In the space between the photosensitive drum 1 and the sleeve 22, there is the developer which is the mixture of the magnetic particles 27 and the toner particles carried on the rotating sleeve 22. It should be noted that the developing system according to this embodiment is essentially different from those disclosed in the above mentioned U.S. Pat. Nos. 4,548,489, 4,579,082 and 4,563,978 in the existence of the magnetic particles in the developing position. Because of the volumetric ratio which will be described hereinafter, of the magnetic particles in the developing position, the amount of the magnetic particles present in this position is far less than in usual so-called magnetic brush developing system, and in this point, the developing system according to this embodiment is essentially different from those magnetic brush developing system. The very small amount of the magnetic particles 27 form sparse chains 51 of the magnetic particles by the magnetic pole **23*a*. Due to the larger movability of the magnetic particles 23 provided by the sparseness, the action of the magnetic particles 27** is peculiar.

More particularly, the sparse chains of the magnetic particles are distributed uniformly in the direction of the magnetic lines of force, and simultaneously, the surface of the sleeve 21 as well as the surfaces of the magnetic particles are opened. Therefore, the toner particles on the magnetic particle surfaces can be supplied to the photosensitive drum without obstruction by the chains, and simultaneously, the uniformly distributed opened portions of the sleeve surface can be established, whereby the toner particles can be transferred from the sleeve surface to the photosensitive surface by the alternating electric field.

Accordingly, from one aspect of the present invention, both of the toner particles 101 deposited or retained on the surfaces of the magnetic particles and the toner particles in the toner particle layer 100 (FIG. 2) on the developer carrying member surface are usable for the developing operation. Substantially the entire surfaces of the magnetic particles are capable of functioning as extensions of the developer carrying member surface. At the same time, the toner particles deposited or retained on the developer carrying member surface can be utilized efficiently as the toner particles for developing movement. As a result, the amount of the toner particles in the toner particle layer 100 on the developer carrying member surface decreases to a large extent after it passes by the developing position as compared with that before passing thereby. Under the preferable conditions, the toner particle layer 100 no longer exists after the development. It should be noted that, according to the present invention, the toner particles on the sleeve 100 is usable for the development, as well as the toner particles 101 on the magnetic particle surfaces.

The description will be made as to the behavior of the magnetic particles and the toner particles. As shown in FIG. 2, the electrostatic latent image in this example is formed by the negative charge (dark portion of the image), so that the electric field by the electrostatic latent image is directed as indicated by an arrow a in FIG. 2. The direction of the electric field provided by the alternating electric field alternates.

In the phase wherein the positive voltage is applied to the sleeve 22, the electric field is co-directional with the electric field of the latent image. At this time, the amount of the electric charge injected into the chains 51 is maximum, and therefore, the chains 51 stand up most, and long chains reach to the surface of the photosensitive drum 1. On the other hand, the toner particles 28 on the sleeve surface and the magnetic particle surfaces are charged in the positive polarity as described hereinbefore, and therefore, they are transferred to the photosensitive drum 1 by the electric field formed in this space. It should be noted here that the erected chains 51 are sparsely distributed, so that the surface of the sleeve 22 is exposed or opened, whereby the toner particles are released both from the surface of the sleeve 22 and the surfaces of the chains 51. Additionally, there is the electric charge having the polarity opposite to that of the toner particles 28 in the chains 51, and therefore, the toner particles 28 on the surfaces of the chains 51 are easy to be released by the electrostatic repelling force.

During the phase wherein the negative voltage is applied to the sleeve 22, the electric field by the alternating voltage (arrow b) and the electric field by the electrostatic latent image (arrow a) are counter-directional. Therefore, the electric field in this space is strong in the opposite direction, so that the amount of charge injection is relatively small. Consequently, the chains 51 are collapsed in accordance with the amount of the charge, and they establish collapsed contact state.

Since the toner particles 28 on the photosensitive drum 1 are charged positive as described hereinbefore, the toner particles 28 transfer back to the sleeve 22 and back to the magnetic particles 27 from the photosensitive drum 1 by the electric field formed across the space. In this manner, the toner particles 28 reciprocate between the photosensitive drum 1 and the sleeve 22 surface and between the photosensitive drum 1 and the magnetic particle surfaces. With the increase of the clearance therebetween caused by the rotation of the photosensitive drum and the sleeve 22, the electric field is weakened, and the developing operation terminates.

At the chains 51, there are triboelectric charge by the friction with the toner particles 28 or image charge and charge injected by the electrostatic latent image charge on the photosensitive drum 1 and the alternating electric field between the photosensitive drum 1 and the sleeve 22. The state of those electric charges depends on the time constant of the charging and the discharging determined by the material of the magnetic particles 27 and other parameters.

In this manner, the chains 51 of the magnetic particles 27 make fine but violent vibrating movement.

Now, the description will be made with respect to the volumetric ratio of the magnetic particles at the developing station. The "developing position" or "developing zone" is defined as the region in which the toner particles are transferred or supplied from the sleeve 22 to the photosensitive drum 1. The "volumetric ratio" is the percentage of the volume occupied by the magnetic particles present in the developing position or zone to the entire volume of the developing position or zone. As a result of the various experiments and considerations, the inventors have found that the volumetric ratio is significantly influential in this developing apparatus, more particularly, it is preferable that the volumetric ratio is 1.5–30%, more preferably 2.6–26%.

If this is smaller than 1.5%, the problems have been confirmed that the image density of the developed image is too low; that a ghost image appears the developed image; a remarkable density difference occurs between the position where the chain 51 exists and the position where no chain exists; and or that the thickness of the developer layer formed on the sleeve 22 is not uniform.

If the volumetric ratio is larger than 30%, the surface of the sleeve is closed, that is, covered by the magnetic particles too much, and a foggy background results.

It should be appreciated that the present invention is based on the finding by the inventors that the image quality does not monotonously become better or worse with the increase or decrease of the volumetric ratio; that the satisfactory image density can be obtained within the range of 1.5–30% of the volumetric ratio; the deterioration of the image is recognized both below 1.5% and beyond 30% of the volumetric ratio; and that in this satisfactory range, neither the ghost image nor the foggy background results. The image deterioration resulting when the volumetric ratio is low is considered as being caused by the negative property, while the deterioration when the volumetric ratio is too large is considered as being caused by the closed or covered sleeve surface resulting from the large amount of the magnetic particles, thus reducing too much the toner supply from the sleeve surface.

If the volumetric ratio is less than 1.5%, the image reproducibility of a line image is not satisfactory with a remarkable decrease of the image density. If it is more than 30%, the magnetic particles can physically damage the surface of the photosensitive drum 1, and the toner particles can be kept deposited on the photosensitive drum as a part of the developed image, which is a problem at the subsequent image transfer or image fixing station.

In the region where the volumetric ratio is near 1.5%, a locally non-uniform development can occur (under particular conditions) when a large area solid black image is developed. For this reason, the volumetric ratio is determined such that this does not occur. For this purpose, it is more preferable that the volumetric ratio is not less than 2.6%, and therefore, this defines a further preferable range.

If the volumetric ratio is near 30%, the toner supply from the sleeve surface can be delayed in such a region adjacent the positions where the chains of the magnetic particles are contacted, for example, when the developing speed is high. If this occurs, a non-uniform developed image can result in the form of scales in the case of solid black image reproduction. In order to assure the prevention of this, the volumetric ratio is preferably not more than 26%.

Where the volumetric ratio is in the range of 1.5–30%, the chains 51 of the magnetic particles are formed on the sleeve surface and are distributed sparsely to a satisfactory extent, so that the toner particles on the chain surfaces and those on the sleeve surfaces are sufficiently opened toward the photosensitive drum 1, and the toner particles on the sleeve 22 are transferred by the alternating electric field. Thus, almost all of the toner particles are consumable for the purpose of development. Accordingly, the development efficiency (the ratio of the toner consumable for the development to the overall toner present in the developing position), and also a high image density can be provided. Preferably, the fine but violent vibration of the chains is produced, by which the toner powder deposited on the magnetic particles and the sleeve surface are sufficiently loosened. In any case, the trace of brushing or occurrence of the ghost image as in the magnetic brush development can be prevented. Additionally, the vibration of the chains enhances the frictional contact between the magnetic particles 27 and the toner particles 28, with the result of the increased triboelectric charging to the toner particles 28, by which the occurrence of the foggy background can be prevented. Also, the high development efficiency is suitable to the reduction of the size of the developing apparatus.

The volumetric ratio of the magnetic particles in the developing position is determined;

$$(M/h)\times(1/\rho)\times[C/(T+C)]$$

where

M is the weight of the developer (the mixture) per unit area of the sleeve surface when the erected chains are not formed ($g/cm^2$);

h is the height of the space of the developing position (cm);

$\rho$ is the true density ($g/cm^3$);

$C/(T+C)$ is the percentage of the magnetic (carrier) particles in the developer on the sleeve.

The percentage of the toner particles to the magnetic particles at the developing position as defined above is preferably 4–40% by weight.

In this embodiment, the alternating electric field is strong enough (large rate of change or large Vpp), the chains 51 are released from the sleeve 22 surface or from their base portions, and the released magnetic particles 27 also reciprocate between the sleeve 22 and the photosensitive drum 1. Since the energy of the reciprocal movement of the magnetic particles is large, he above described effect of the vibration are further enhanced.

The above described behavior has been confirmed by a high speed camera available from Hitachi Seisakusho, Japan operable at the speed of 8000 frames/sec.

Even in the case where the clearance is reduced between the photosensitive drum 1 surface and the sleeve 22 surface so as to increase the contact pressure between the photosensitive drum 1 and the magnetic particle chains 51 and to decrease the vibration, the clearance is still large enough at the inlet and outlet sides of the developing position, and therefore, the vibration is sufficient with the above described advantages.

On the contrary, if the clearance is increased it is preferable that the magnetic particle chains 51 are contacted to the drum 1 surface when the electric field is applied, even if they do not contact the drum surface without the electric field.

When the magnetic particles having a relatively low resistance are used, the alternating voltage applied between the photosensitive drum 1 and the sleeve 22 is selected such that at the peaks thereof, the electric discharge does not occur therebetween at the dark portions or light portions of the latent image. When the chains of the magnetic particles having a relatively high resistance are used, the voltage is preferably selected such that the voltage across the clearance reaches a discharge on-set voltage by suitably selecting the frequency of the alternating voltage and selecting the charge and discharge time constant of the chains of the magnetic particles.

With those taken into account, the resistance of the entire chain in the direction of the height thereof measured with the chain being contacted to the photosensitive drum 1, is preferably $10^{15}$–$10^{6}$ ohm-cm. When the developing electrode effect of the chain 51 is expected, it is preferably $10^{12}$–$10^{6}$ ohm.cm, and more preferably $10^{10}$–$10^{6}$ ohm.cm.

U.S. Pat. Nos. 4,040,969 and 4,126,454 disclose a consideration to the carrier particle size and its distribution, but without the application of the alternating electric field. Those U.S. Patents disclose a coating ferrite carrier having an average particle size of not less than 100 microns, but its particle size distribution is such that 50% or more of not less than 75 microns particles is contained.

The present invention is based on the finding that the particle size distribution of the carrier particles has much influence to the amount of electric charge to the toner particles.

The average particle size of 45–75 microns is preferable for the magnetic carrier particles. In general, the carrier particles having smaller average particle size provide better triboelectric charging of the toner on the sleeve 22, and the less sleeve ghost is produced. The occurrence of the sleeve ghost results in that the density of the developed image is lower immediately after a solid black image is developed, or the image density of the developed image decreases with rotation of the sleeve. Correspondingly, however, when the average particle size is small, there is a tendency that the magnetic particles are readily deposited onto the latent image bearing member. The position where the magnetic particles are deposited is different depending on the resistance of the magnetic particles. For example, the magnetic particles having a relatively low resistance are deposited on the image area, while those having a relatively high resistance are deposited on the non-image area. This is a general tendency, and actually, it depends more or less on the magnetic properties of the magnetic particles, the surface configurations thereof and the material of the surface treatment including the resin coating.

When the magnetic field on the sleeve at the developing station is 600–900 Gausses (magnetic flux density), the deposition of the magnetic particles increases when the average particle size of the magnetic particles is smaller than 45 microns. On the contrary, when it is larger than 75 microns, the sleeve ghost becomes remarkable. Therefore, it is preferable in order to provide a uniform solid black image without the sleeve ghost that the average particle size of the magnetic particles is not more than 75 microns. Further, it is preferable in order to prevent the increased deposition of the magnetic particles onto the image bearing member that the average particle size is not less than 45 microns, since otherwise after long term use of the apparatus, only a small amount of magnetic particles remains in the developer container with the result of increased foggy background.

Figure 6:
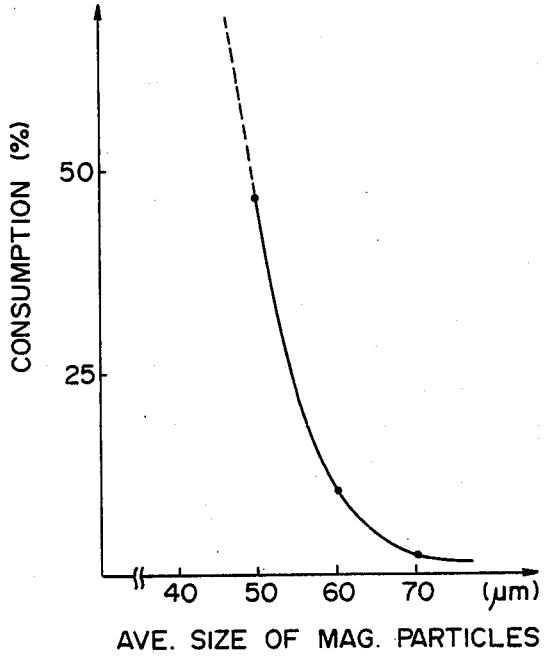
FIG. 6 is a graph indicating a relationship between magnetic particle consumption and particle sizes of the magnetic particles in the developing apparatus of FIG. 1.
Figure 7:
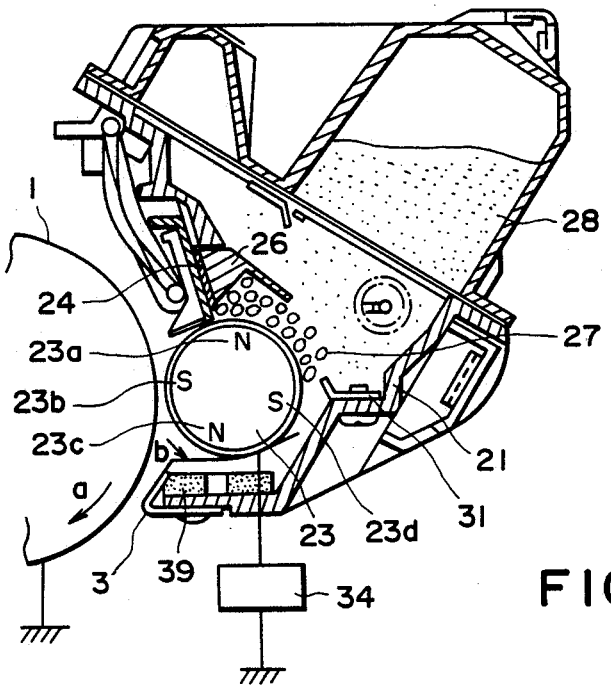
FIG. 7 is a sectional view of a developing apparatus according an embodiment of the present invention.

FIG. 6 is a graph indicating a relationship between the average particle size of the magnetic particles and a consumption rate of the magnetic particles. The consumption rate Z is defined as follows.

$$Z=(A-B)\times 100/A\%$$

A: weight of the magnetic particles when they are supplied into the developer container (g)

B: weight of the magnetic particles remaining in the developer container after operation of durability test (g)

The graph of FIG. 6 shows the results when the developing apparatus of FIG. 1 was operated with the magnetic flux density on the sleeve at the developing position being approx. 800 Gausses. The developing apparatus was assembled into a copying machine, PC-10 available from Canon Kabushiki Kaisha, Japan and a test chart having A4 size was used as the original, while copy sheets of A4 size was used. The consumption rate was determined when 1500 copy sheets were copied. The used magnetic particles were of ferrite and were coated by silicon resin (maximum magnetization of 60 emu/g). They were substantially electrically insulative, having resistance of approx. $1\times 10^{9}$ ohm.cm. In the PC-10 copying machine, a DC component of a developing bias voltage during non-operation, was set to be −250 V with respect to the surface potential of the photosensitive drum (image bearing member) so as to effectively preventing the toner from depositing on the drum. Since the toner was positively chargeable, it was not deposited on the photosensitive member. However, the high resistance magnetic particles were negatively charged with the result that they were deposited onto the photosensitive drum during non developing operation, so that they were consumed. Therefore, the consumption rate of the magnetic particles shown in FIG. 6 is fairly high. If the developing bias and the magnetic flux density at the developing station are property selected, it is possible that the consumption rate is made lower than 10% even if the average particle size of 50 microns. However, with the magnetic particles having the particle size of less than 45 microns, it is very difficult to maintain sufficiently low rate of consumption even if the developing bias or the magnetic flux density at the developing station are changed.

It is desirable in order to provide stabilized images for long period of time that the consumption of the magnetic particles is decreased. To achieve this, it is preferable that the average particle size is not less than 45 microns. Additionally, when the average particle size is less than 45 microns, the magnetic particles on the developing sleeve become easily agglomerated, with the result of a scale pattern when a solid black is developed.

Therefore, from this standpoint, too, the average particle size not less than 45 microns is preferable.

From the foregoing analysis, it is very preferable that the average particle size is between 50–60 microns. Additionally, however, it found that there is a preferable range of the particle size distribution. The following Table explains this.

TABLE

| | Magnetic Particles | | Image quality (Initial stage) | | | | | |
|---|---|---|---|---|---|---|---|---|
| Materials | Content (%) of particles ≦45 microns | Content (%) of particles ≧75 microns | Image density | Fog (Pos.) | Fog (Rev.) | Deposition to solid black | Deposition to solid white | Sleeve ghost (solid black) |
| A | 5 | 35 | 1 | 5 | 5 | 2 | 2 | 4 |
| B | 5 | 30 | 1 | 4 | 4 | 2 | 2 | 3 |
| C | 10 | 20 | 2 | 2 | 2 | 2 | 2 | 2 |
| D | 15 | 15 | 2 | 2 | 2 | 2 | 2 | 2 |
| E | 20 | 10 | 3 | 1 | 2 | 2 | 4 | 2 |
| F | 25 | 5 | 3 | 1 | 2 | 4 | 6 | 2 |

Evaluations:
1, 2, 3, 4, 5, 6
←Better

The Table shows the resultant image qualities when six kinds (A–F) of magnetic particles of ferrite material coated with silicon resin having the average particle size of 50–60 microns. The six kinds of magnetic particles had different particle size distribution, particularly noting the contents by weight of the particles having the particle size not less than 75 microns and of the particles having the particle size not more than 45 microns.

As will be understood from the Table, the materials B, C, D and E showed the good results. The material A involved the problem of the foggy background in the positive and negative developments and also involved the problem of slight sleeve ghost in the case of solid black image development. It is considered that the material A contains 35% of the particles having the particle size of not less than 75 microns, and therefore, the total surface areas of the magnetic particles is smaller than the other materials, resulting in insufficient triboelectric charging of the toner particles, which leads to the foggy background. Also, similarly to the case of larger average particle size, the slight sleeve ghost is produced.

The material F involves the problem of a larger amount of magnetic particles being deposited on the white area of the drum. Usually, the magnetic particles deposited on the white area are hardly transferred to the transfer sheet but is collected by the cleaning device, since the magnetic particles are electrically charged to the polarity, the same as that of the transfer corona (the opposite polarity to that of the toner). In general, it is not preferable that the magnetic particles are mixed into the toner collected by the cleaning device, with the exception of the case that the magnetic carrier particles are positively deposited onto the white area in a certain type of development. If a large amount of the magnetic particles are consumed, the absolute amount thereof decreases, with the result that the triboelectric charge applicable to the toner particles is reduced, whereby the foggy background is produced. With the decrease of the particle size of the magnetic particles, the consumption of the magnetic particles increases so that the triboelectric charge of the toner decreases. From the foregoing analysis, it is preferable that 20 or less % of the magnetic particles having the particle size not more than 45 microns is contained.

The magnetic particle contains only magnetic material or may contain magnetic material and non-magnetic material. In addition, the magnetic particle may contain two or more magnetic materials mixed.

Next, the description will be made with respect to a so-called V-D curve, that is, the relation of the developed image density with respect to the surface potential of the latent image in the developing apparatus according to this embodiment.

Figure 3:
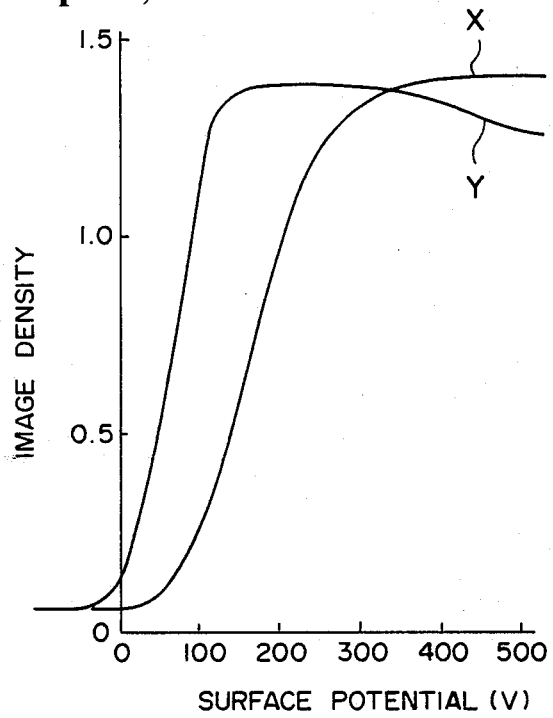
FIG. 3 is a graph indicating the development property of the developing apparatus of FIG. 1.

FIG. 3 is a V-D curve graph, wherein the V-D curve in this apparatus is indicated by a reference X, and wherein the reflection density of the developed image measured by a Macbeth density meter is plotted against the potential difference between the photosensitive drum potential and the sleeve surface potential when the sleeve surface potential is assumed to be zero. It is understood that the V-D curve is excellent since it indicates that the background fog does not result at the low potential region, and the appropriate inclination is provided in the intermediate potential region, and still the sufficient image density can be provided at the high potential region. As an example of a V-D curve of a developing apparatus not using the present invention, that of the developing apparatus disclosed in U.S. Pat. Nos. 4,548,489, 4,579,082 and 4,563,978 wherein one component non-magnetic developer layer is opposed to a latent image under the existence of an alternating electric field, the developer layer being thin on the sleeve surface, is given in FIG. 3 and is indicated by a reference Y. As will be understood, the negative developing property appears, that is, in a range beyond a certain potential, the image density decreases with increase of the potential. This provides a tendency that the image density is not sufficient in a high potential region. As contrasted to this V-D curve, the property of the present invention is much better, since the foggy background is not produced in the low potential region; since the inclination is relatively less steep in the intermediate region, and therefore, the edge effect is not extreme; since the negative property does not appear in the intermediate potential region; and since the sufficient image density can be obtained in the high potential region.

Then, the conditions will be discussed to form preferable chains of the magnetic particles.

Figure 4:
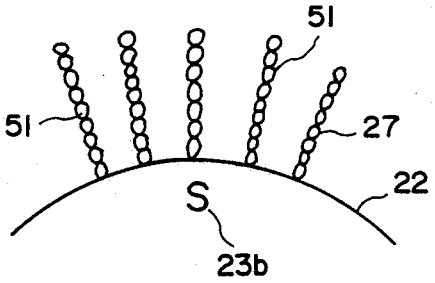
FIG. 4 is a sectional view illustrating a preferable formation of magnetic particle chains in the developing apparatus of FIG. 1.

FIG. 4 illustrates the chains which are preferable in the developing position, wherein the chains are formed independently from each other and wherein the chains are distributed uniformly over the sleeve 22 surface.

Figure 5:
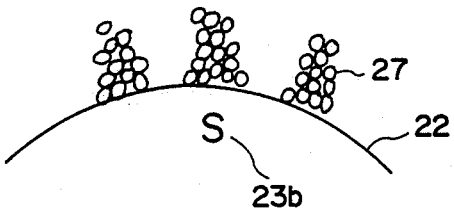
FIG. 5 is a sectional view illustrating an unpreferable formation of the magnetic particle chains.

FIG. 5 illustrates chains which are not preferable, wherein the magnetic particles 27 are in the form of masses. It has been found that if the development is effected with those masses of the magnetic particles, non-uniform pattern in the form of scales have appeared in an image, and therefore, this is not preferable.

Further, the production of the mass of the magnetic particles is influenced by the material of the blade 24 and by an angle between the edge of the blade and the magnetic pole 23*a* seen from the center of the sleeve 22.

As for the material of the blade 24, non-magnetic material is preferable. When magnetic material is used, the magnetic lines of force are concentrated on the blade 24, with the result that the magnetic force for confining the magnetic particles is strong. In order for the magnetic particles to overcome the confining force and to go out of the container 21, a mass over a certain degree is required. Until such a mass is reached, they stay in the neighborhood of the blade 24 due to the strong magnetic confining force. Only when the mass reaches a sufficient level, the mass of the magnetic particles becomes able to advance out of the container 21. This is considered as being the reason why the magnetic particles are in the form shown in FIG. 5 when they reach the developing position on the sleeve 22.

Where the blade 24 is of non-magnetic material, the magnetic lines of force do not concentrate adjacent the edge of the blade 24, and therefore, the above-described mass is not produced, but the developer is applied uniformly over the sleeve. Consequently, the uniform and sparse chains are formed in the developing position. For this reason, the blade 24 is preferably of a non-magnetic material. However, if the magnetic property is weak as when provided by bending a stainless steel (SUS304-JIS), such a magnetic material is usable.

As to the angle $\theta$, if it is less than 2 degrees, the mass of the magnetic particles is produced, or the developer is not formed as a uniform layer on the sleeve 21. The reason for this is considered as follows. Since then, the magnetic particles are sparsely distributed along the magnetic lines of force adjacent the blade 24, and therefore, the magnetic particles are advanced only after a predetermined amount of the magnetic particles are stagnated here. On the other hand, if the angle $\theta$ is larger than 40 degrees, the effect of regulating the amount of the magnetic particles is extremely decreased. From this, it has been found that the angle $\theta$ is preferably not less than 2 degrees but not more than 40 degrees, further preferably, not less than 5 degrees but not more than 20 degrees.

The relationship between the angle $\theta$ and the amount of the developer passed under the blade edge is like this. With the decrease of the angle $\theta$, the amount decreases, and therefore, the volumetric ratio at the developing station decreases. If the angle $\theta$ is increased, the opposite results. The amount of the toner particles applied on the surface of the sleeve 22 is substantially independent from the angle $\theta$, that is, it is substantially constant.

A developing apparatus was constructed according to this embodiment, as shown in FIG. 1. As for the sleeve 22, an aluminum sleeve having the diameter of 20 mm was used after the surface thereof is treated by irregular sand-blasting with ALUNDUM abrasive. Within the sleeve 22, the magnet 23 magnetized with four poles was used, the N and S poles being arranged alternately along the circumference as shown in FIG. 1. The maximum surface magnetic flux density by the magnet 23 was approximately 900 Gauss.

The blade 24 used had the thickness of 1.2 mm made of non-magnetic stainless steel. The angle $\theta$ was set 15 degrees.

As for the magnetic particles, ferrite particles (maximum magnetization of 60 emu/g) had the particle size of 70–50 microns (20% by weight of the magnetic particles having not less than 75 microns particle size: and 15% by weight of the magnetic particles having not more than 45 microns particle size; lower percentages are further preferable), whose surface was treated by silicon resin.

As for the non-magnetic toner, blue powder provided by a mixture of 100 parts of styrene/butadiene copolymer resin and 5 parts of copper phthalocyanine pigments, and added by 0.6% of the colloidal silica, was used. The average particle size of the toner particles was 10 microns. Upon operation, approx. 20–30 microns thickness of the toner layer was obtained on the sleeve 22 surface, and above the toner layer, the magnetic particle layer of 100–200 microns thickness was formed. On the surfaces of the magnetic particles, there were toner particles.

At that time, the total weight of the magnetic particles and the toner particles on the sleeve 22 was approximately $2.43\times10^{-2}$ g/cm$^2$.

The magnetic particles were formed into erected chains at and adjacent the developing position by the magnetic pole 23*b* within the sleeve 22. The maximum height of the chains was approximately 0.9 mm.

The amount of electric charge was measured by a blow-off method, and the triboelectric charge of the toner particles on the sleeve 22 and the magnetic particles was +10 mC/g.

The developing apparatus was assembled into a commercial copying machine, PC-10 sold by Canon Kabushiki Kaisha, Japan. The clearance between the surface of the photosensitive drum 3 made of organic photoconductor material and the surface of the sleeve 22 was set 350 microns. They were moved at the same peripheral speed, more particularly 66 mm/sec. The volumetric ratio under those conditions was approximately 10% ($h=350$ microns, $M=2.43\times10^{-2}$ g/cm$^2$, $\rho=5.5$ g/cm$^3$, $C/(T+C)=20.4\%$). The bias voltage source 34 provided an alternating voltage having the frequency of 1600 Hz, wherein an alternating voltage having the peak-to-peak value of 1300 V was superimposed with a DC voltage of −300 V. When this was operated, good blue images were obtained.

The volumetric ratio of the magnetic particles in the developing position is determined;

$$(M/h)\times(1/\rho)\times[C/(T+C)]$$

where

M is the weight of the developer (the mixture) per unit area of the sleeve surface when the erected chains are not formed (g/cm$^2$);

h is the height of the space of the developing position (cm);

$\rho$ is the true density (g/cm$^3$);

$C/(T+C)$ is the percentage of the magnetic (carrier) particles in the developer on the sleeve.

The developing operation was performed to obtain a solid image, and then the surface of the sleeve 22 was carefully observed after the developing operation. It was confirmed that almost all of the toner particles on the sleeve and on the magnetic particles were consumed up, and therefore, the developing operation was effected with almost 100% development efficiency.

It was confirmed that the development properties were good enough without foggy background, and the V-D curve was as indicated by the reference X in FIG. 3.

As described in the foregoing, the present embodiment is advantageous in the high image density, high development efficiency, no foggy background, no ghost image, no trace of brushing and no negative property.

Usable materials for the sleeve 22 are conductive material such as aluminum, brass and stainless steel and a cylinder of paper or synthetic resin. By processing the surface of those cylinders with conductive material, or by constituting the surface by a conductive material, it can serve as a developing electrode. As an alternative, a core roller is used which is wrapped by a conductive and elastic member, for example, a conductive sponge.

As regards the magnetic pole **23*b*** at the developing position, it is disposed at the center of the developing station in the direction of the movement of the surfaces of the photosensitive member and the sleeve. However, it may be deviated from the center, or the developing position may be disposed between magnetic poles.

To the toner powder, silica particles may be added to enhance the flowability, or abrasive particles or the like may be added to abrade the surface of the photosensitive drum 1 (latent image bearing member) in an image transfer type image forming apparatus. To the toner powder a small amount of magnetic particles may be added. Magnetic particles may be used if the magnetic property thereof is very weak as compared with that of the magnetic particles and is triboelectrically chargeable.

In order to prevent the occurrence of the ghost image, the developer layer remaining on the sleeve 22 after the developing action may be once scraped off by scraper means (not shown), and then the scraped sleeve surface is brought into contact to the magnetic particle layer in the container, and then the developer is applied thereon. This is effective to prevent the ghost image.

A mechanism may be added to the developing apparatus, which detects the content of the magnetic particles and the toner particles, and in response to the detection, the toner is automatically supplied.

The developing apparatus according to the present invention is usable with a disposable developing device which contains as a unit the container, the sleeve and the blade 24, although it is applicable to the usual developing device which is fixed in an image forming apparatus.

As described, according to the embodiment of the present invention, a high image density of the developed image can be provided with high development efficiency.

Referring to FIGS. 7–12, description will be made with respect to a method and apparatus according to an embodiment of the present invention wherein a substantially stationary layer mainly containing the magnetic carrier particles is formed. The detailed description will be omitted for the parts which are the same as with FIG. 1 for the purpose of simplicity. The structures and features of FIG. 1 are applicable to the present embodiment.

The container 21 contains the developer which is a mixture of the magnetic carrier particles 27 and the non-magnetic toner particles 28. In this embodiment, the developer containing the toner particles and magnetic carrier particles constitutes a movable layer 35 in the neighborhood of the surface of the sleeve 22, while a stationary layer 30 is formed in a position away from the surface of the sleeve 22. The movable layer moves following the movement of the sleeve surface. Outside the stationary layer, there is formed an outside layer containing substantially only the toner particles. The stationary layer 30 is substantially unmovable, that is, the overall layer 30 does not at all moves, or it may move at an extremely low speed, i.e., preferably not more than 1 mm/sec, more preferably not more than 0.1 mm/sec when the movable layer 35 moves at a speed not less than several tens mm/sec.

The sleeve 22 is made of a non-magnetic material such as aluminum and is disposed in the opening of the container 21 with a part of its surface is exposed and the rest of the surface within the container 21. The sleeve 22 is rotatably supported along an axis perpendicular to the sheet of the drawing and is rotated in operation in the direction of an arrow B at the substantially same speed as that of the photosensitive drum.

The stationary layer 30 is formed by the magnetic field provided by the magnetic poles **23*a* and 23*d*, and also by the developer movement limiting member 26**.

The limiting member 26 is mounted to the inside surface of the blade 24, and serves to limit the moving region of the magnetic particles within the container 21. As an alternative, a mesh bag containing the magnetic particles may be used to forcedly establishing the stationary layer.

Before operation of the developing apparatus, the magnetic particles 27 are first supplied into the container 21. The supplied magnetic particles are retained on the sleeve 22 by the magnetic poles **23*a* and 23*d* to form magnetic particle layer over the entire surface of the sleeve 22 within the container 21. Subsequently, toner particles 27 are supplied into the container 21 so as to form a toner layer outside the magnetic particle layer. The limiting member 26 having a surface contacting the magnetic carrier particles in this embodiment applies to the magnetic particles in the neighborhood thereof such forces as is effective to cancel the resultant force of a force exerted by the rotation of the sleeve to move the magnetic carrier particles, a confining force provided by the magnetic poles 23*a* and 23*d*** and the gravity by the weight of the magnetic carrier particles. Thus, the stationary layer mainly containing the magnetic carrier particles is established.

It is preferable that the magnetic powder first supplied into the container 21 contains 2–70% by weight of the toner, but the powder may consist only of magnetic particles. After the magnetic particles 27 are once attracted to the surface of the sleeve 22 as the magnetic particle layer, they do not significantly flow or incline even when the developing apparatus is vibrated or quite inclined, and they keep covering the surface of the sleeve 22. When the sleeve 22 rotates in the direction indicated by an arrow, the magnetic particles move upwardly in the direction along the surface of the sleeve 22 from the bottom portion of the container 21 to reach the neighborhood of the blade 24.

Here, the movement of the magnetic particles is divided into two. Adjacent to the sleeve surface, a moving layer 35 is formed which moves in the direction of the sleeve rotation at a peripheral speed ranging between the minimum (0.5–20% of the sleeve peripheral speed) and the maximum (100% thereof). Outside the movable layer, there is formed a substantially unmovable stationary layer 30. A constantly stationary portion of the stationary layer extends to the position indicated by a reference **30-*a*, and the stationary layer expands or contracts in the region beyond the position 30-*a*, which will be described in detail hereinafter. The lower end of the stationary layer 30 cooperates with a magnetic member 31 serves to constitute a magnetic field seal in the neighborhood of the bottom portion of the container 21 (disclosed in U.S. Ser. No. 911,765, filed Sept. 26, 1986 and now U.S. Pat. No. 4,838,200, issued June 13, 1989 which are assigned to the assignee of the present application) to form toner receiving opening A, through which the magnetic particles in the movable layer 35 takes the toner particles from the toner layer. The magnetic powder containing the toner particles in the movable layer passes through the clearance formed between the blade 24** and the sleeve surface and is carried on the sleeve surface to the developing position.

By forming the substantially stationary layer mainly with the magnetic particles, a triboelectric charging effect is provided to the surface of the movable layer 25 since the stationary layer itself contains the toner particles and magnetic carrier particles, and in addition, the balance is provided between the toner particle supply and the toner particle collection. Thus, the performance of the development is enhanced. Simultaneously, the stationary layer is effective to prevent the toner particles insufficiently charged are taken into the movable layer from being immediately conveyed out of the container 21, whereby a stabilized developing layer is supplied to the developing position.

By the movement provided by the sleeve rotation, the toner particles 28 in the movable layer 35 are triboelectrically charged by the friction with the magnetic particles 27 and with the surface of the sleeve 22.

Before the blade 24, the magnetic particles 27 adjacent the surface of the sleeve 22 are attracted to the surface of the sleeve 22 by the magnetic pole 23*a*, so that they passes through the clearance under the blade 24 by the sleeve rotation to go out of the container 21, together with the toner particles deposited on the surfaces thereof. A part of the charged toner particles 28 is maintained deposited on the sleeve surface by image force so that they are conveyed out of the container 21. Here, the blade 24 functions to limit or regulate the amount of the developer conveyed out of the container on the sleeve surface.

The layer of the developer (the mixture of the magnetic particles 27 and the toner particles 28) formed on the sleeve 22 surface is carried on the surface of the sleeve 22 to reach the developing position or zone, where the sleeve 22, and therefore the layer is opposed to the surface of the photosensitive drum 1. In the developing position, the toner particles are transferred onto the latent image on the photosensitive drum 1 both from the surfaces of the magnetic particles and from the surface of the sleeve 22 by an alternating electric field formed across the clearance between the photosensitive drum 1 and the sleeve 22, whereby the latent image is developed. In this embodiment, the alternating electric field is applied, but another no method may be used. With the continued rotation of the sleeve 22, the toner particles and magnetic particles not having been consumed in the developing operation are collected back into the container 21. They are mixed with the particles in the container 21 by the above described toner taking action and circulation, and are again supplied on the sleeve 22. During this circulation, the magnetic powder immediately takes thereinto the toner particles from the toner layer adjacent the bottom of the container 21, whereby it is replenished with the toner by the amount which has been consumed.

Figure 8:
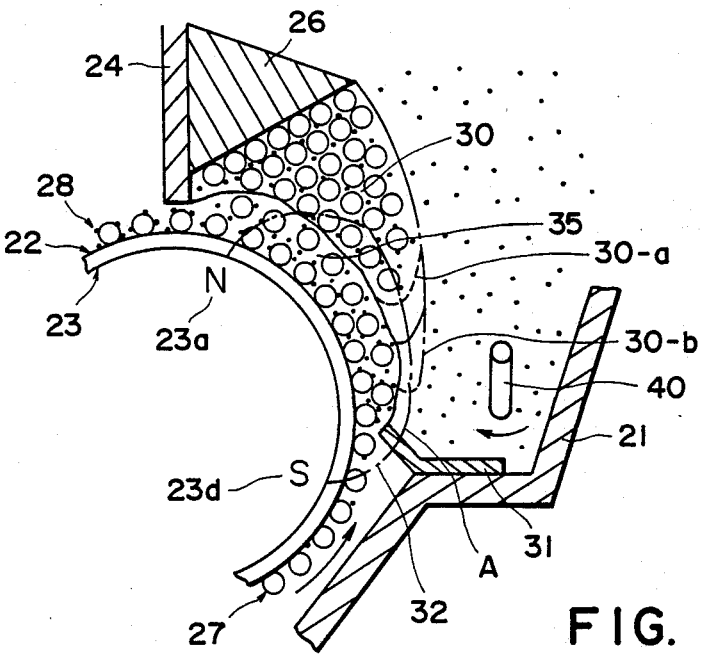
FIGS. 8 and 9 are enlarged sectional views of a part of FIG. 1 apparatus, particularly illustrating a stationary layer.

Each of the magnetic particles may be of magnetic material such as ferrite, or a coated ferrite particle, or a binder type magnetic carrier or the like. The insulative toner may be non-magnetic or magnetic (preferably having weaker magnetic property than the magnetic carrier particles). Referring to FIG. 8, which is an enlarged sectional view, the behavior of the magnetic particles adjacent the toner supplying opening will be described. The most preferable situation will be described with respect to a constantly stationary layer portion (30-*a*). When the toner content is proper the stationary layer extends to a position indicated by a solid line below the broken line (39-*a*). With consumption of the toner particles at the developing station, the toner content in the developer, defined as $$[\text{toner content (g)} \times 100]/[\text{magnetic particle content (g)} + \text{toner content (g)}](\%)$$

decreases so that the apparent volume V of the developer decreases. At this time, together with the reduction of the volume of the movable layer 35, the stationary layer 30 deforms, but the constant part of the stationary layer 30-*a* hardly changes, that is, it remains to be stationary layer. However, the lower end portion of the stationary layer quickly contract along the magnetic line 32 of force produced by the fixed magnetic poles from the upstream side to the downstream side with respect to movement of the sleeve surface, thus deforms into the shape indicated by broken line 30-*a*. The broken line stationary layer is the constantly stationary layer. By this contraction, the direct contact area between the movable layer 35 and the toner layer is increased, so that the toner receiving opening A is enlarged, thus enhancing the toner taking action of the magnetic powder. In this manner, the toner content of the developer is increased. When, on the contrary, the toner content increases, the volume V of the developer increases. Together with the increase of the volume of the movable layer 35, the shape of the stationary layer 30 deforms along the magnetic line 32 of force such that the lower end of the stationary layer expands toward the upstream side quickly deform, so that the stationary layer comes to have the shape indicated by the broken line 30-*b*. By this, the contact area between the movable layer 35 and the toner layer reduces, and therefore, the toner receiving or supplying opening is reduced. In this manner, the amount of the toner received by the magnetic powder is reduced or closed, with the result that the amount of the toner received by the magnetic powder is reduced. In this manner, the toner content is reduced. As will be understood, the apparent stationary layer (30-*a*–30-*b*) deforms along the magnetic line 32 of force so as to function as an automatic shutter for controlling the amount of supply of the toner to the magnetic powder.

Figure 9:
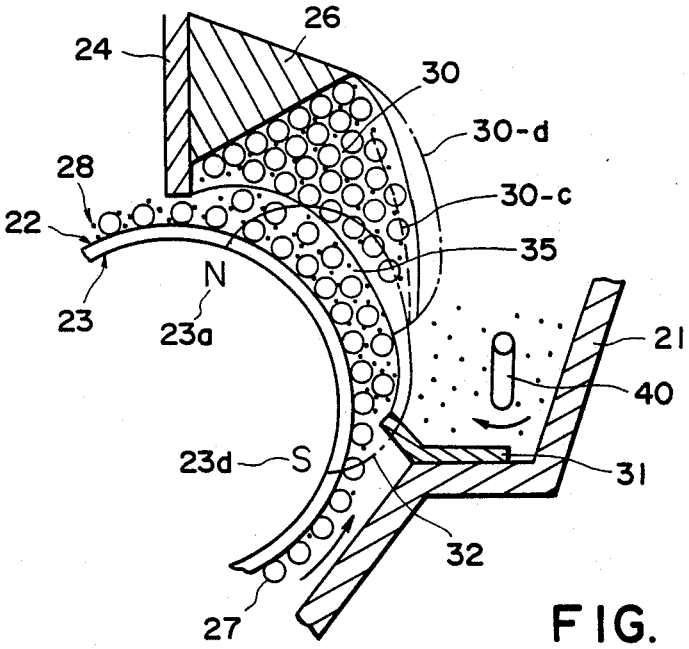

However, if the magnetic confining force to the magnetic particles by the fixed magnetic field is not enough, or if the configuration of the limiting member 26 is not proper, or if the quantity of the developer is not enough, then the stationary layer possibly does not move along the magnetic line of force, and as a result, the stationary layer deforms by changing its thickness as shown in FIG. 9 in accordance with the change of the toner content. More particularly, when the toner content decreases, the shape 30-*c* is taken, whereas when the toner content increases, the shape 30-*d* is taken. Therefore, the stationary layer cannot function as the above described shutter, and therefore, the toner supply to the movable layer is not controlled. Still, however, the other advantages of the stationary layer are provided, such as the substantial friction with the movable layer, the toner balance and the prevention of insufficiently charged toner from entering.

Considerations have been made to arrangement and magnitude of the magnetic poles of the stationary magnetic field generating means, configuration of the limiting member, amount of the developer, configuration of the developer container and others, in order to ensure the deformation of the stationary layer along the magnetic line of force as shown in FIG. 8, unlike FIG. 9.

By stabilizing the stationary layer and controlling the movable layer, the toner content is stabilized, and in addition, the specific charge of the toner particles is stabilized.

Figure 10:
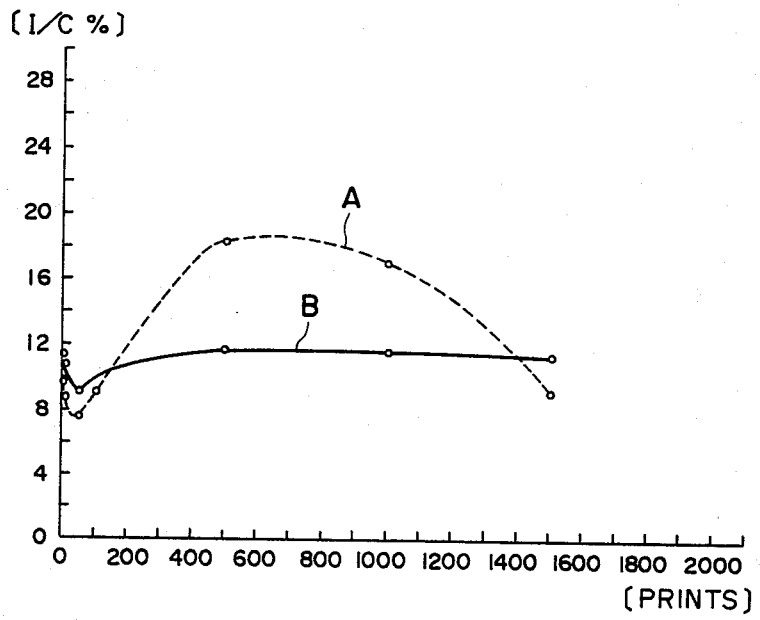
FIG. 10 graph indicating change of T/C ratio with use of the shown in FIG. 7.

FIG. 10 shows a change of the toner content during continuous 1500 copy operations. In this Figure, reference character A indicates the case where the stationary layer is not stabilized, and B indicates the case of FIG. 9 where the stationary layer is stabilized. Thus, it has been confirmed that if the stationary layer is stabilized, and if the stationary layer expands or contracts, the toner content is stabilized. Also, it has been confirmed that the stabilization of the toner content is very much concerned with the stabilization of the specific charge of the toner particles. In this embodiment, the specific charge of the toner particles was approx. 14 micro coulomb measured by a suction method.

Figure 12:
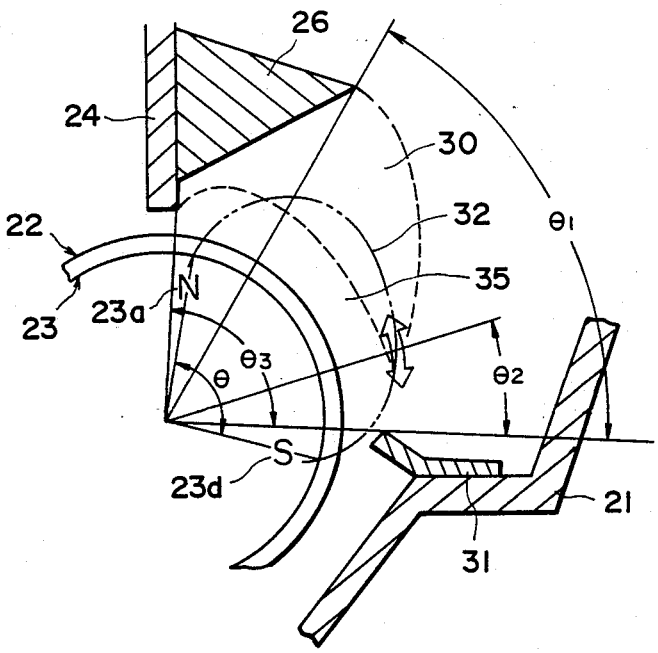
FIG. 12 is a sectional view illustrating arrangement of magnetic poles in the apparatus shown in FIG. 7.

FIG. 12 shows the preferable structure, wherein an angle $\theta$ seen from the center of the sleeve and between maximum magnetic flux density positions of the magnetic poles 23*a* (N) and 23*d* (S) is larger than an angle $\theta 1$ formed by the inside region of the container 22 as seen from the center of the sleeve 22, and the angle $\theta 1$ is contained within the angle $\theta$. By doing so, the above described magnetic line of force can be formed with the above described advantages.

Referring back to FIG. 8, the description will be made as to the movable layer 35. Immediately after the toner is taken into the magnetic powder through the opening defined by the magnetic member 31 and the stationary layer 30, the most of the toner particles do not have electrical charge. However, they are gradually charged in the movable layer by the mixing with the magnetic particles 27 to such an extent that the charge is suitable to the development. Before they reach immediately before the blade 24, almost all of the toner particles are uniformly charged triboelectrically. Therefore, the movable layer 35 is very much concerned with the charge application to the toner. The movable layer 35 is placed under the pressure exerted by the outside stationary layer 30, by which the charge application in the movable layer is controlled. Considering the interaction between the movable layer and the stationary layer, the existence of the stationary layer is significant from the standpoint of controlling the movable layer. In order to deform the stationary layer along the magnetic line of force in a stabilized manner, it is preferable to provide an auxiliary means to stabilize the stationary layer.

Figure 11:
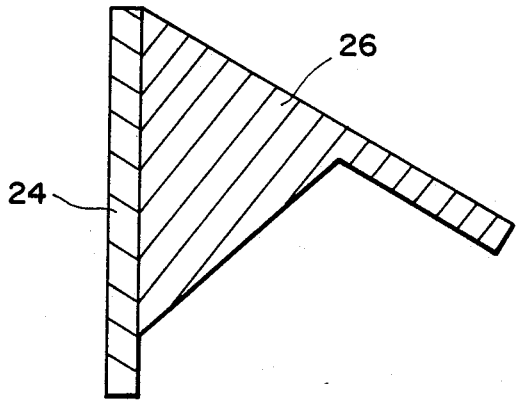
FIG. 11 is a view of a member for limiting movement of the developer in the apparatus of FIG. 7.

FIG. 11 shows a modification of the limiting member 26 for the purpose of stabilizing the stationary layer.

In this modified structure, a visor extends from the limiting member 26 such that it extends along the magnetic line of force to cover the stationary layer so as to limit the upper portion of the stationary layer and a leading end portion with respect to movement of the sleeve. By the provision of the visor, the stationary layer is further stabilized. As an alternative, the stationary layer may be stabilized by magnetic confining force by, for example, using a magnetic member.

Thus, in order to stabilize the stationary layer and to control the amount of the toner taken into the magnetic powder, it is preferable that the stationary layer expands or contracts along the magnetic line 32 of force adjacent an edge of the toner supplying opening. Therefore, it is preferable that the magnetic lines of force extend in such a direction that the toner supplying opening changes. In this embodiment, as shown in FIG. 12, the magnetic poles are disposed outside the toner supplying or receiving opening (angle $\theta 1$ in a broad sense), by which the magnetic line 32 of force can be extended substantially along the outer periphery of the sleeve 22. By this, the stationary layer 30 is further stabilized, with the further stabilization of the toner content of the developer. Simultaneously, the magnetic line of force can be extended in the manner that it enables the stationary layer 30 to function as the shutter of the opening corresponding to an angle $\theta 2$. Accordingly, the developing apparatus can provide a developed image without foggy background and without non-uniformness, with even better characteristics of response. Further, it is preferable to provide a toner supplying member 40 rotatable in the direction of an arrow to positively supply the toner to the opening.

As described in the foregoing, according to this embodiment of the present invention, the developer mixture containing the toner particles and magnetic particles can be produced by simple and inexpensive mechanism, and in addition, the proper toner content required for the development can be maintained, whereby a high quality of the developed image can be always provided.

Figure 13:
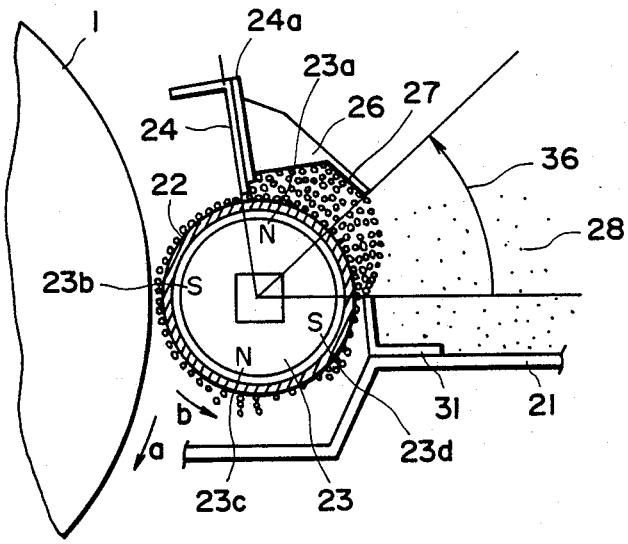
FIGS. 13, 14 and 15 are sectional views of the developing apparatus, illustrating toner particle movement.
Figure 14:
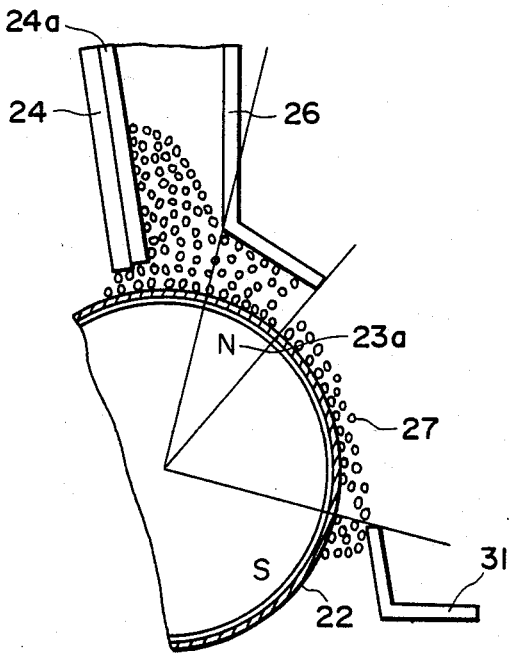
Figure 15:
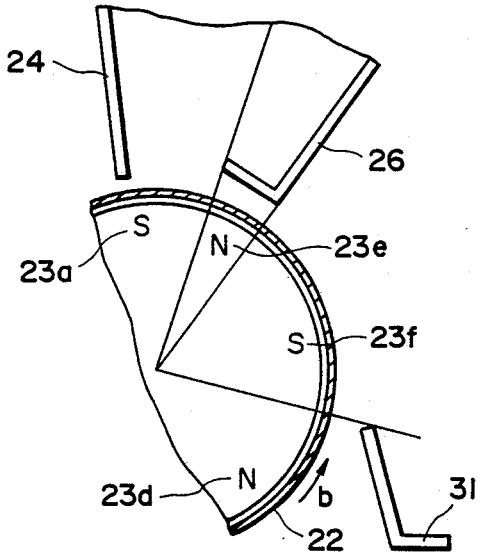

Referring to FIGS. 13–15, the description will be made with respect to control of the opening for the magnetic powder to take the toner particles.

In FIG. 13, the limiting member 26 described with FIG. 11 is employed. As for the developer layer control means, a non-magnetic blade 24, magnetic member 24*a* and the limiting member 26 are connected and arranged in this order toward an upstream side of the sleeve rotation. The distance from the sleeve surface 22 increases in this order, too. In this embodiment, the magnetic member 24*a* is disposed downstream of the maximum magnetic flux density position of the magnetic pole 23*a* with respect to movement of the sleeve surface 22, and functions as an auxiliary magnetic blade assisting the function of the non-magnetic blade 24. The auxiliary blade is effective to remove non-uniform thickness of the layer which may otherwise be caused by an unavoidable error in the manufacturing of the non-magnetic blade 24.

The limiting member 26 is generally opposed to the regulating magnetic pole 23*a* and within the influence of the magnetic field thereby.

The embodiment shown in FIG. 13 is a further improvement of the apparatus of FIG. 8. The toner supplying opening 36 defined by the magnetic member 31 of the container 21 and a free end of the visor of the limiting member 26 is effective to supply the toner particles into the magnetic powder. Preferably, a stationary layer of the developer is formed in the opening 36 so that the actual toner supply is effected at the upstream side of the opening 36. More particularly, the magnetic particle layer formed adjacent the surface of the sleeve 22 is formed into a movable magnetic particle layer which moves following the movement of the surface of the sleeve 22 and which is close to the sleeve surface, and into a stationary layer which is substantially unmovable by being stopped by the limiting member 26.

At least a lower portion of the toner supplying opening 36, the movable layer is exposed to receive the toner. In accordance with the change of the toner content in the magnetic particle layer, the volume of the stationary layer changes. More particularly, when the toner content increases, the volume of the stationary layer increases to reduce the width of the toner supplying opening (the width of the area where the movable layer is exposed to the toner layer) so as to reduce the amount of the toner taken into the magnetic powder. On the contrary, when the toner content decreases, the stationary layer volume decreases with the result that the opening is enlarged so as to increase the amount of the toner taken into the magnetic particle powder. By those operation, the toner content is stabilized.

In the developing apparatus of this embodiment, only the regulating magnetic pole 23*a* is disposed opposed to the inside of the container 21, and no magnetic pole is opposed to the toner supplying opening. The limiting member 26 is disposed within the influence of the magnetic pole 23*a* and above the magnetic pole 23*a*. By the limiting member 26, the stationary layer is formed, and therefore, the toner content is stabilized by the above described mechanism. Further, formation of the magnetic brush adjacent the regulating magnetic pole 23*a* is prevented. Since no magnetic pole is disposed opposed to the toner supplying opening 36, overdosing of the toner to the magnetic powder is prevented, which may otherwise be caused by a sparse magnetic brush of the magnetic particles taking very large amount of the toner particles. This further stabilize the toner content, and increases the pressure in the magnetic particle layer within the closed space so that the capability of charging the toner is increased. As a whole, extremely stabilize developer layer can be formed. Accordingly, a good image without foggy background and without non-uniformness can be provided.

Experiments were carried out under the following conditions:

General structure: FIG. 13
Sleeve diameter: 20 mm
Photosensitive drum diameter: 60 mm
Regulating magnetic pole 23*a:* 900 Gausses
Developing magnetic pole 23*b:* 950 Gausses (sleeve surface)
Conveying magnetic poles 23*c* and 25*d:* 800 Gausses
Limiting member 26: at the regulating magnetic pole 23*a* position spaced by 4 mm from the surface of the sleeve As for the magnetic particles, ferrite particles coated with a resin material having the average particle size of 50 microns were used. The used toner had an average particle size of 12 microns which was insulative and non-magnetic. The developing apparatus was assembled into a commercial copying machine, PC-10 sold by Canon Kabushiki Kaisha, Japan. The dark area potential on the photosensitive member VD was 600 V, while the light area potential VL was 220 V with the process speed of 66 mm/sec. The developing bias voltage was produced by an alternating voltage having a peak-to-peak voltage of 1.3 KVpp and a frequency of 1.6 KHz superposed with a DC voltage of −300 V. When this was operated, good images were obtained without fog and non-uniformness. This was maintained even after the continuous 2000 copying operations.

In the foregoing embodiment, the developing bias used was a combination of the alternating voltage and a DC voltage. However, DC bias only is usable.

In the developing apparatus of this embodiment, the magnetic particle layer, including the stationary layer, is completely confined by the magnetic within the developing sleeve 22, and therefore, non-uniform distribution of the magnetic particles does not easily occur even if the developing apparatus is inclined or vibrated. Therefore, stabilized images without non-uniformness can be provided.

In the foregoing embodiment, the limiting member 26 forms a substantially completely closed space to produce the stationary layer, whereby the strong pressure is applied to the developer layer so as to sufficiently charge the toner particles. However, when a light pressure toner particles such as those used with a pressure fixing type fixing device wherein a toner image is fixed by a line pressure of several kg, extremely high pressure can deteriorate the developer in the developing apparatus. Therefore, it is preferable to reduce the pressure exerted by the limiting member 26.

FIGS. 14 and 15 show embodiments wherein the pressure is reduced by providing space immediately before the blade 24 and downstream of the limiting member 26 with respect to the movement of the surface of the sleeve.

In FIG. 14, the regulating magnetic pole 23*a* is located away from the blade 24, and the limiting member 26 is disposed opposed to the regulating magnetic pole 23*a*. The behavior of the magnetic particles in this embodiment is such that with the rotation of the sleeve 22, the magnetic particles moves from the bottom of the container along the sleeve surface while taking thereinto the toner particles. When the magnetic particles reaches the regulating magnetic pole 23*a* position, they are formed into a brush by the magnetic field to form a magnetic curtain between the limiting member 26. By this magnetic curtain, the toner overdosed into the magnetic powder is squeezed to maintain the stabilized toner content. In the chamber providing the above described space, the developer not conveyed out by the sleeve, stagnates so as to apply a moderate pressure to the developer to maintain the charging effect. The load effective to charge the developer depends on the amount of the magnetic particle layer stagnated, and therefore, by controlling it, the better development property can be provided.

In this embodiment, the space is formed between the blade 24 and the limiting member 26, so that the influence of the regulating magnetic pole 23*a* is not strong with the result that the regulation of the layer formation is other difficult. From this standpoint, it is preferable that the auxiliary magnetic blade 24*a* is mounted behind the blade 24. By this, the coating of the developer layer on the sleeve is stabilized.

In this embodiment, the limiting member 26 is disposed opposed to the regulating magnetic pole 23*a*, but it may be disposed independently thereof.

FIG. 15 shows such an embodiment. In this embodiment, the limiting member 26 is disposed opposed to the magnetic pole 23*e* which is upstream of the regulating magnetic pole 23*a*. Upstream of the magnetic pole 23*e*, there is a magnetic pole 23*f* disposed to the toner supplying opening. The magnetic pole 23*f* is used to improve the conveyance of the developer, and it is not absolutely necessary.

The behavior of the magnetic particles are the same as with FIG. 14 embodiment, and therefore, the detailed explanation is omitted.

In this embodiment, it is preferable that a part or all of the portion of the limiting member 26 which is opposed to the sleeve is made of magnetic material in order to strengthen the above described toner filtering effect by enhancing the magnetic curtain by the magnetic pole 23*e*. According to this embodiment, the desired functions can be distributed to the respective magnetic poles, and therefore, more stabilized developer layer, and therefore, a developed image, can be provided.

In this embodiment, even if the toner is overdosed into the magnetic powder through the toner supplying opening by a provision of a magnetic particle opposed to the opening, the filtering effect to the toner by the magnetic curtain can maintain the stabilized and proper toner content can be maintained.

As described in the foregoing, a magnetic poles is disposed downstream of the toner supplying opening and upstream of the regulating member, and a developer limiting member is disposed within the influence of the magnetic field thereby, whereby the toner content in the developer layer can be maintained, and the triboelectric charge is sufficiently applied to the toner, so that a good image can be produced without foggy background and non-uniformness.

The present invention includes any combination of the structures respectively described above, as will be readily understood from the explanation.

The existence of the stationary layer and the change thereof in accordance with the toner content, described above, have been confirmed in the following manner:

1. In the device shown in FIG. 1, for example, a mixture of the magnetic carrier particles and toner particles wherein the toner content is the same as used in the actual developing operation, e.g. 12%, is supplied to the device. At this time, no additional toner particles for forming the toner layer is supplied.

2. The sleeve 22 is rotated without developing operation. Seeing from the above, it is confirmed that a stationary layer is formed on a movable layer.

3. All the developer is removed from the same device, and then a mixture developer having lower toner content, 4, 8 or 10%, is supplied into the device. No additional toner is supplied, similarly to paragraph 1.

4. The sleeve 22 is rotated, similarly to paragraph 2. Seeing from the above, it is confirmed that the stationary layer is formed and that the size of the stationary layer is smaller and that the movable layer is increased.

5. In the developing device as shown in FIG. 13, the stationary layer is confirmed if the longitudinal end plate is of transparent material.

The moving speed of the stationary layer has been confirmed in the following manner:

1. The device of FIG. 1 is prepared with its longitudinal plate made of transparent material. A developer having a predetermined toner content is supplied, and then additional toner is supplied to form the toner layer. Here, the toner particles are red.

2. The sleeve 22 is rotated without developing operation to establish an initial operable state.

3. The developing sleeve 22 is stopped, and a small amount of blue toner, for example, 1 $mm^3$ is added into the stationary layer. With or without developing operation, the developing sleeve is rotated, and the position of the blue toner is determined at a regular interval, using a scale mounted to the transparent plate beforehand. Thus, the speed of the stationary layer is determined.

4. The same measuring operation is effected with respect to the direction of the thickness of the stationary layer to obtain the speed distribution in the stationary layer. Thus, the clear difference can be confirmed from the behavior of the movable layer. The colors are not limited to those stated above. Alternatively, colored carrier particles may be used in place of the colored toner particles.

The toner supply to the movable layer and the existence and maintenance of the stationary layer have been confirmed in the following manner:

1. A developer mixture having a predetermined toner content is supplied into the device, wherein the toner particles are red, and then blue toner particles are supplied thereon. The sleeve is rotated, and the developing operation is performed.

2. Initially the movable is red, but with repeated developing operation, the blue toner is taken into the movable layer, and finally the movable layer changes to blue.

3. The toner particles in the toner layer on the stationary layer is removed to check the stationary layer. It is confirmed that the toner particles in the stationary layer are red, the same as the initial state. Looking into deep of the stationary layer, the toner particles therein changes from red to blue. This is the boundary between the stationary layer and the movable layer. Thus, it is confirmed that the stationary layer does not take thereinto the toner particles from the toner layer.

4. Since the longitudinal end plate is transparent in this case, too, it is confirmed that the toner in the toner layer is taken into the movable layer through the above described opening.

As will be readily understood when the speed of the movement in the stationary layer is mentioned to, it means the movement or circulation within the stationary layer, since the stationary layer is maintained.

The present invention includes any combination of the structures respectively described above, as will be readily understood from the explanation.

While the invention has been described with reference to the structures disclosed herein, it is not confined to the details set forth and this application is intended to cover such modifications or changes as may come within the purposes of the improvements or the scope of the following claims.

What is claimed is:

1. A developing method comprising the steps of forming a latent image and developing said latent image under an alternating electric field at a developing position with a developer containing magnetic carrier particles and toner particles, wherein an average particle size of the magnetic carrier particles is not less than 45 microns and not more than 75 microns, and wherein a particle size distribution of the magnetic carrier particles is such that the magnetic particles having a particle size not more than 45 microns is not more than 20% by weight, and the magnetic particles having a particle size of not less than 75 microns is not more than 30% by weight.

2. A method according to claim 1, wherein the magnetic carrier particles have an average particle size of not less than 50 microns and not more than 60 microns and have a particle size distribution wherein not more than 45 microns is not more than 15% by weight, and not less than 75 microns is not more than 20% by weight.

3. A method according to claim 1, wherein at a developing position where the developer carried on a developer carrying member is opposed to the latent image to be developed, an alternating electric field is applied, wherein the toner particles electrically charged to a polarity opposite to that of the magnetic carrier particles are transferred from a developer layer formed on the developer carrying member to develop the latent image.

4. A method according to claim 3, wherein the toner particles deposited on the surfaces of the magnetic carrier particles are also transferred to the latent image to develop it.

5. A developing method wherein a developing layer including a mixture of magnetic carrier particles and toner particles is carried on a rotatable developer carrying sleeve, in which magnetic field generating means is stationarily disposed, to a developing position where a latent image is developed by the toner particles, comprising:

forming a substantially stationary layer containing the magnetic particles on the developer layer carried on the developer carrying member in a developer container for containing the magnetic carrier particles and the toner particles;

forming, in the container, a toner particle supplying area upstream of the stationary layer with respect to movement of the developer carrying sleeve for supplying toner particles from the toner particle layer to the developer layer carried on the developer carrying sleeve; and allowing an upper portion of the stationary layer to change its thickness measured along a radial direction of the sleeve in accordance with a toner content in the developer layer to control the toner particle supply area thereby.

6. A developing method wherein a developer including a mixture of magnetic carrier particles and toner particles is carried on a rotatable developer carrying sleeve in which magnetic field generating means is stationarily disposed, to a developing position where a latent image is developed by the toner particles, comprising the steps of:

forming a substantially stationary layer containing the magnetic particles on a layer of developer carried on the developer carrying sleeve in a developer container for containing the magnetic carrier particles and the toner particles;

forming a toner particle layer on the stationary layer in the container;

providing a toner particle supply area upstream of the stationary layer with respect to movement of the developer carrying sleeve, for supplying toner particles from the toner particle layer to the developer layer carried on the developer carrying sleeve in the container; and allowing the stationary layer to expand and contract along a path of the developer layer carried on the developer carrying sleeve in accordance with a toner content in the developer carried on the sleeve so as to control the toner particles supplying area.

7. A method according to claim 6, wherein the magnetic carrier particles contained in the developer container have an average particle size not less than 45 microns and not more than 75 microns, and wherein the magnetic carrier particles having particle sizes not more than 45 microns is not more than 20% by weight, and the magnetic carrier particles having particle sizes not less than 75 microns is not more than 30% by weight.

8. A method according to claim 7, wherein the carrier particle is coated with insulative resin material, and wherein the developer develops the latent image under application of an alternating electric field.

9. A method according to claim 8, wherein the magnetic carrier particles have a particle size distribution wherein not more than 45 microns is not more than 15% by weight, and not less than 75 microns is not more than 20% by weight.

10. A method according to claim 6, wherein a volumetric ratio which is a ratio of the total volume of the magnetic particles existing at the developing position to a volume of space defined by the surface of an electrostatic latent image bearing member bearing the latent image to be developed and the developer carrying member at the developing position, is 1.5–30%.

11. A method according to claims 5 or 6, wherein the substantially stationary layer moves in a direction of peripheral movement of the developer carrying sleeve at a speed not more than 1 mm/sec.

12. A method according to claims 5 or 6, wherein the stationary layer is defined at a downstream end with respect to peripheral movement of the sleeve by a surface of a limiting member, and is defined at a surface extending from the downstream side to an upstream side by another surface of the limiting member.

13. A method according to claims 5 or 6, wherein the developer develops the latent image under application of an alternating electric field.

14. A developing apparatus for developing a latent image, comprising:

a developer container for containing a developer of a mixture of magnetic carrier particles and toner particles, said container including a regulating member for providing a regulated thickness of a developer layer;

a rotatable developer carrying member of non-magnetic material for carrying the developer layer of toner particles and magnetic particles supplied by said developer container;

a magnet stationarily disposed inside said developer carrying member, said magnet being provided with first and second magnetic poles having different magnetic polarities for forming a magnetic field extending substantially parallel with a surface of the developer carrying member in a developer supplying opening;

a limiting member projected into said container, said limiting member having a surface for substantially stopping the developer moving by rotation of the developer carrying member;

a projection member projecting into said container at a position upstream of said limiting member with respect to the movement direction of said developer carrying member, said projection member and said limiting member forming an angle $\theta 1$ seen from a center of said developer carrying member; and wherein positions where maximum magnetic flux densities of the first and second magnetic poles are formed are outside the angle $\theta 1$, and a substantially stationary layer containing magnetic particles extending from said regulating member is formed along the developer carrying member by the first and second magnetic poles and said limiting member to form in the container a variable toner taking area through which an amount of the toner is substantially taken into the developer layer carried on the developer carrying member upstream of the stationary layer with respect to peripheral movement of the developer carrying member, and wherein the size of the substantially stationary layer changes in accordance with the toner content of the developer carried on the developer carrying member to control the toner taking area.

15. An apparatus according to claim 14, wherein the substantially stationary layer moves at a speed not more than 1 mm/sec when the peripheral speed of the developer carrying member is not less than 10 mm/sec.

16. An apparatus according to claim 15, wherein the stationary layer moves at a speed not more than 0.1 mm/sec.

17. An apparatus according to claim 14, wherein said limiting member is provided with a surface abutted to a surface of the stationary layer remote from said developer carrying member.

18. An apparatus according to claim 14, wherein the first magnetic pole is disposed downstream of the second magnetic pole with respect to peripheral movement of the developer carrying member and upsteam of a developer layer regulating portion of said regulating member, said apparatus further comprising means for forming an alternating electric field between said developer carrying member and a member for bearing a latent image to be developed.

19. An apparatus according to claim 18, wherein the toner particles electrically charged are supported on said developer carrying member and on the magnetic carrier particles at a developing zone where the development is effected, with those toner particles.

20. An apparatus according to claim 19, wherein said magnetic carrier particles are insulative, and wherein the magnetic carrier particles having particle sizes not more than 45 microns is not more than 20% by weight, and the magnetic carrier particles having particle sizes not less than 75 microns is not more than 30% by weight.

21. An apparatus according to claim 20, wherein not more than 45 microns is not more than 15% by weight, and not less than 75 microns is not more than 20% by weight.

22. An apparatus according to any one of claims 14–17 or 18–21, wherein said projection member is a magnetic member for forming a magnetic seal.

23. A developing apparatus for developing an electrostatic latent image on an electrostatic latent image bearing member, comprising:

a developer container for containing a developer including toner particles and magnetic particles;

a developer carrying member, opposite to the electrostatic latent image bearing member, for forming a developing position for supplying the toner particles to the latent image bearing member and for carrying the developer containing toner particles and magnetic carrier particles from said container to the developing position;

first magnetic field generating means disposed across said developer carrying member from the latent image bearing member for generating a magnetic field to contact the magnetic particles to the latent image bearing member at the developing position;

developer regulating means disposed upstream of the developing position with respect to movement of a surface of said developer carrying member and spaced apart from the surface of said developer carrying member for regulating the developer carried to the developing position;

second magnetic field generating means disposed across said developer carrying member from said regulating member and upstream of said developer regulating member with respect to the movement of the developer carrying member; and alternating electric field generating means for forming an alternating electric field at the developing position to transfer at least the toner particles carried on said developer carrying member to the latent image bearing member;

wherein the magnetic particles have an average particle size of 50–60 microns and have a particle size distribution wherein not more than 45 microns is not more than 20%, and not less than 75 microns is not more than 30% by weight.

24. An apparatus according to claim 23, wherein the particle size distribution is not more than 45 microns is not more than 15% by weight, and not less than 75 microns is not more than 20% by weight.

25. An apparatus according to claim 23, wherein said magnetic carrier particles are coated with insulative resin material, and wherein a magnetic flux density provided by said first magnetic field generating means on a surface of the developer carrying member is not less than 600 Gausses and not more than 900 Gausses.

26. A developing apparatus for developing a latent image with a developer containing a mixture of magnetic carrier particles and toner particles, comprising:

a developer container, provided with an opening, for containing the developer;

a rotatable developer carrying member disposed in the opening of said developer container for carrying the developer containing toner particles and magnetic carrier particles out of said container to a developing position where the latent image is developed with the developer;

means for regulating a layer of the developer to be carried to the developing station on said developer carrying member, wherein said regulating means includes a non-magnetic regulating member and a magnetic member disposed upstream of the non-magnetic regulating member with respect to peripheral movement of said developer carrying member and stationary magnetic field generating means disposed across said developer carrying member from the non-magnetic regulating member, the non-magnetic regulating member and the magnetic member having ends disposed within influence of a magnetic field produced by the magnetic field generating means; and a limiting member disposed so as to be influenced by the magnetic field formed by said magnetic field generating means and upstream of said magnetic member with respect to peripheral movement of said developer carrying member and disposed opposed to a surface of said developer carrying member to form a substantially stationary layer containing magnetic carrier particles, wherein at a position upstream of the stationary layer with respect to movement direction of said developer carrying member, a supply region for supplying the toner to the developer layer supported on said developer carrying member is formed and wherein a size of the substantially stationary layer changes in accordance with the toner content in the developer carried on the developer carrying member to control the supply region.

27. An apparatus according to claim 26, wherein said non-magnetic regulating member, the magnetic member and the limiting member are connected in this order.

28. An apparatus according to claim 27, wherein said non-magnetic regulating member is closer to said developer carrying member than the magnetic member.

29. An apparatus according to claim 26, wherein said limiting member is spaced apart from the magnetic member to form a space for containing the developer by said developer carrying member, the limiting member and the magnetic member.

30. An apparatus according to claim 26, further comprising means for forming an alternating electric field.

* * * * *

UNITED STATES PATENT AND TRADEMARK OFFICE

CERTIFICATE OF CORRECTION

PATENT NO. : 4,916,492

DATED : April 10, 1990

INVENTOR(S) : NORIHISA HOSHIKA, ET AL.

It is certified that error appears in the above-identified patent and that said Letters Patent is hereby corrected as shown below:

On the title page:

IN [54] TITLE

"DEVELOPER" should read --DEVELOPING--.

COLUMN 1

Line 1, "DEVELOPER" should read --DEVELOPING--.

COLUMN 3

Line 19, "apparatus" should read --apparatus whereby--.
Line 54, "FIG. 10" should read --FIG. 10 is a--.
Line 55, "the shown" should read --the apparatus shown--.
Line 56, "a view" should read --a sectional view--.

COLUMN 4

Line 41, "is" should be deleted.

COLUMN 6

Line 58, "those" should read --the--.

COLUMN 7

Line 47, "system." should read --systems.--.

UNITED STATES PATENT AND TRADEMARK OFFICE

CERTIFICATE OF CORRECTION

PATENT NO. : 4,916,492

DATED : April 10, 1990

INVENTOR(S) : NORIHISA HOSHIKA, ET AL.

It is certified that error appears in the above-identified patent and that said Letters Patent is hereby corrected as shown below:

COLUMN 8

Line 16, "is" should read --are--.
Line 47, "easy to be" should read --easily--.

COLUMN 9

Line 1, "charge" should read --charges--.

COLUMN 11

Line 42, "to" should read --on--.
Line 48, "the" (first occurrence) should be deleted.

COLUMN 12

Line 34, "was" should read --were--.
Line 44, "preventing" should read --prevent--.
Line 56, "of" should read --is--.
Line 62, "long" should read --a long--.

COLUMN 13

Line 21, "when" should read --of--.
Line 48, "is" should read --are--.

UNITED STATES PATENT AND TRADEMARK OFFICE

CERTIFICATE OF CORRECTION

PATENT NO. : 4,916,492

DATED : April 10, 1990

INVENTOR(S) : NORIHISA HOSHIKA, ET AL.

It is certified that error appears in the above-identified patent and that said Letters Patent is hereby corrected as shown below:

COLUMN 15

Line 64, "set 15" should read --set at 15--.

COLUMN 16

Line 32, "set" should read --set at--.

COLUMN 18

Line 3, "moves," should read --move,--.
Line 10, "is" should be deleted.

COLUMN 19

Line 1, "31 serves" should read --31 and serves--.
Line 8, "takes" should read --take--.

COLUMN 20

Line 24, "contract" should read --contracts--.

COLUMN 23

Line 17, "those operation," should read --these operations,--.
Line 33, "stabilize" should read --stabilizes--.
Line 37, "lize" should read --lized--.

UNITED STATES PATENT AND TRADEMARK OFFICE

CERTIFICATE OF CORRECTION

PATENT NO. : 4,916,492

DATED : April 10, 1990

INVENTOR(S) : NORIHISA HOSHIKA, ET AL.

It is certified that error appears in the above-identified patent and that said Letters Patent is hereby corrected as shown below:

COLUMN 24

Line 6, "magnetic" should read --magnet--.
Line 34, "moves" should read --move--.
Line 37, "reaches" should read --reach--.

COLUMN 25

Line 1, "are" should read --is--.
Line 18, "can be maintained" should be deleted.
Line 19, "poles" should read --pole--.
Line 39, "is" should read --are--.

COLUMN 26

Line 25, "is" should read --are--.
Line 29, "changes" should read -=-change--.
Line 38, "to," should read --too,--.
Line 60, "is" should read --are--.
Line 62, "is" should read --are--.

COLUMN 27

Line 53, "supply" should read --supplying--.

COLUMN 28

Line 1, "is" should read --are--.
Line 3, "is" should read --are--.

UNITED STATES PATENT AND TRADEMARK OFFICE

CERTIFICATE OF CORRECTION

PATENT NO. : 4,916,492

DATED : April 10, 1990

INVENTOR(S) : NORIHISA HOSHIKA, ET AL.

It is certified that error appears in the above-identified patent and that said Letters Patent is hereby corrected as shown below:

COLUMN 29

Line 38, "is" should read --are--.
Line 40, "is" should read --are--.

Signed and Sealed this

Thirteenth Day of October, 1992

*Attest:*

DOUGLAS B. COMER

*Attesting Officer*

*Acting Commissioner of Patents and Trademarks*